US010493615B2

(12) United States Patent
Liu

(10) Patent No.: US 10,493,615 B2
(45) Date of Patent: Dec. 3, 2019

(54) HAND TOOL WITH PIVOTABLE HEAD

(71) Applicant: Chao-Chih Liu, Taichung (TW)

(72) Inventor: Chao-Chih Liu, Taichung (TW)

( * ) Notice: Subject to any disclaimer, the term of this patent is extended or adjusted under 35 U.S.C. 154(b) by 184 days.

(21) Appl. No.: 15/866,466

(22) Filed: Jan. 10, 2018

(65) Prior Publication Data

US 2019/0210210 A1 Jul. 11, 2019

(51) Int. Cl.
*B25G 1/06* (2006.01)
*B25B 23/00* (2006.01)
*B25G 3/38* (2006.01)

(52) U.S. Cl.
CPC ..... *B25G 1/063* (2013.01); *B25B 23/0007* (2013.01); *B25G 3/38* (2013.01)

(58) Field of Classification Search
CPC ... B25B 23/0007; B25B 23/0028; B25G 3/38; B25G 1/06; B25G 1/063
USPC ..... 81/177.7, 177.8, 177.9
See application file for complete search history.

(56) References Cited

U.S. PATENT DOCUMENTS 7,841,262 B1 * 11/2010 Tsai ..... B25G 1/06 81/177.7
8,671,809 B1 * 3/2014 Chen ..... B25B 23/00 81/177.7
8,850,932 B2 * 10/2014 Tsai ..... B25B 13/461 81/177.7
9,242,366 B2 * 1/2016 Liu ..... B25G 1/063
2016/0016297 A1 * 1/2016 Chang ..... B25B 23/0028 81/177.8
2016/0144491 A1 * 5/2016 Huddy ..... B25B 23/0028 81/60

* cited by examiner

*Primary Examiner* — David B. Thomas

(57) ABSTRACT

A hand tool includes a handle and a head which includes a protrusion having a toothed portion. The handle includes a connection portion formed on one end thereof. Two lugs extend from the connection portion to form a recess between the two lugs and the connection portion. Two ribs respectively extend from the connection portion and ARE located between the two lugs. The two ribs are integral with the two lugs and the connection portion. The protrusion of the head is pivotably connected between the two lugs and the toothed portion is engaged with a control unit located in the recess. The two ribs restrict the angle that the head is pivoted relative to the handle.

5 Claims, 7 Drawing Sheets

HAND TOOL WITH PIVOTABLE HEAD

BACKGROUND OF THE INVENTION

1. Fields of the Invention

The present invention relates to a hand tool, and more particularly, to a hand tool with a pivotable head.

2. Descriptions of Related Art

The conventional hand tool 10 known to applicant is disclosed in FIG. 5 and comprises a handle 20 and a head 30 which is pivotably connected to the handle 20. The handle 20 includes two lugs 50 extending axially from one end thereof so as to form a recess 40 between the two lugs 50. The head 30 includes a protrusion 301 which has a toothed portion 302. The protrusion 301 is pivotably connected between the two lugs 50 by extending a pin 60 through the two lugs 50 and the protrusion 301 as shown in FIGS. 6 and 7. A resilient member is located in the recess 40 and is engaged with the toothed portion 302. The head 30 is pivotable relative to the handle 20 so as to access the object to be tightened or loosened in different situations.

However, when the head 30 is pivoted an angle and the hand tool outputs a torque, the two lugs 50 apply a force to the protrusion 301 so as to rotate the head 30 to tighten or loosen the object. Therefore, the two lugs 50 are suffered with high torque and may gradually be deformed. The recess 40 becomes wider, and the toothed portion 302 of the head 30 may not be properly engaged with the resilient member. The head 30 is not stable and cannot output high torque.

The present invention intends to provide a reinforcement structure for securing the head of the hand tool to eliminate the shortcomings mentioned above.

SUMMARY OF THE INVENTION

The present invention relates to a hand tool and comprises a head having a protrusion extending therefrom. The protrusion has a toothed portion. A handle has a connection portion formed on one end thereof. Two lugs extend from the connection portion so as to form a recess between the two lugs and the connection portion. Two ribs respectively extend from the connection portion and are located between the two lugs. The two ribs are integral with the two lugs and the connection portion. The protrusion of the head is pivotably connected between the two lugs. A control unit is located in the recess and engaged with the toothed portion. The two ribs restrict the angle that the head is pivoted relative to the handle.

Preferably, a first axis passes through the center of the inner end of the recess, and a second axis extends along the top of each of the ribs. A restriction angle is formed between the first axis and each of the second axes. The restriction angle is between 60 degrees to 75 degrees, including 60 degrees and 70 degrees.

Preferably, the protrusion of the head and each of the two lugs has a hole. A pin extends through the holes of the protrusion of the head and each of the two lugs to pivotably connect the protrusion of the head between the two lugs.

Preferably, the ribs each have a first height, and the two ribs each have a second height which is higher than the first height.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
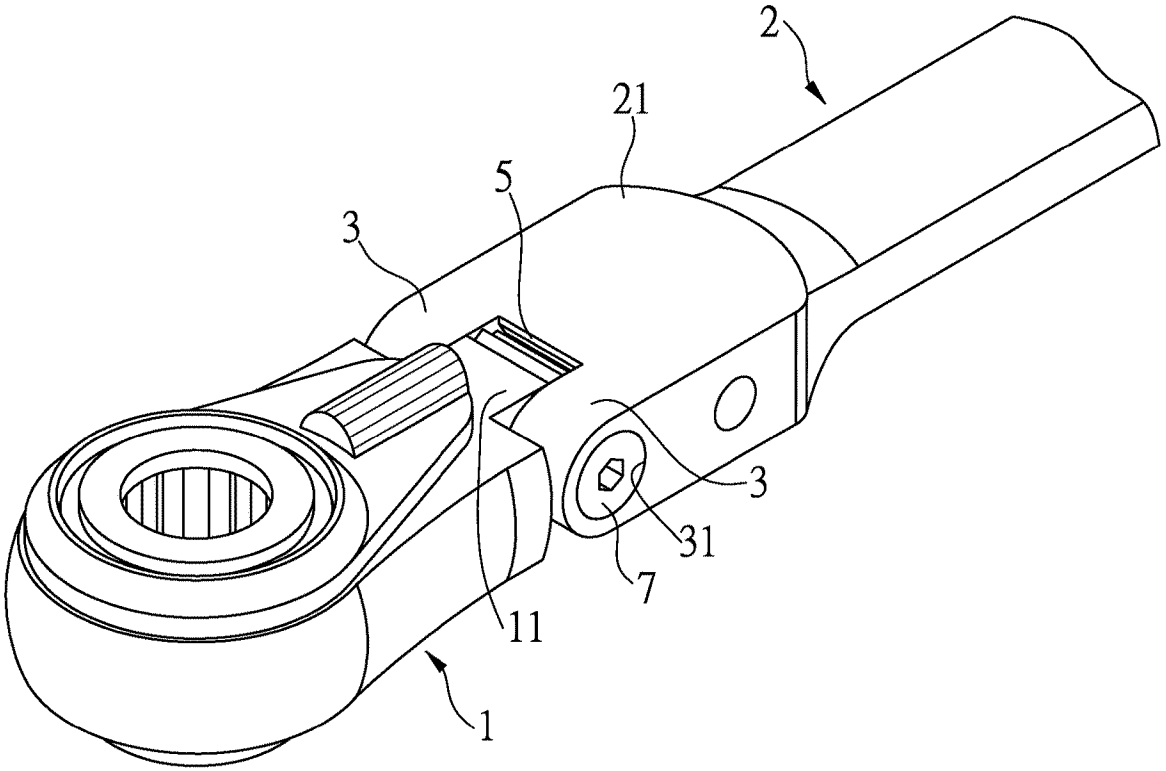
FIG. 1 is a perspective view to show the hand tool of the present invention.
Figure 2:
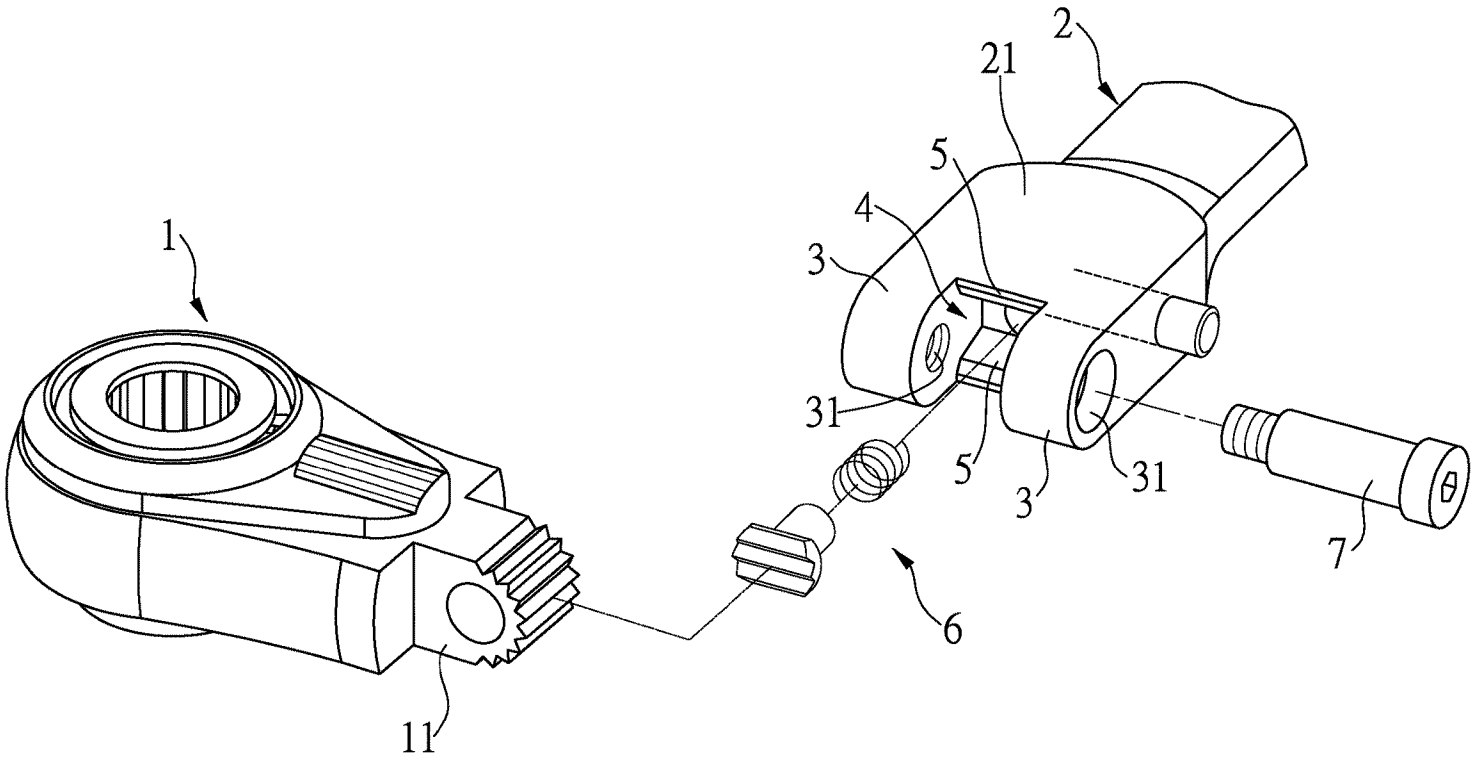
FIG. 2 is an exploded view of the hand tool of the present invention.

Referring to FIGS. 1 to 4, the hand tool of the present invention comprises a head 1 having a protrusion extending therefrom, and the protrusion includes a toothed portion 11 formed along a curved distal end of the protrusion. A handle 2 includes a connection portion 21 formed on one end thereof. Two lugs 3 extend from the connection portion 21 so as to form a recess 4 between the two lugs 3 and the connection portion 21. Two ribs 5 respectively extend from the connection portion 21 and are located between the two lugs 3. The two ribs 5 are integral with the two lugs 3 and the connection portion 21. The protrusion of the head 1 and each of the two lugs 3 has a hole 31. A pin 7 extends through the holes of the protrusion of the head 1 and each of the two lugs 3 to pivotably connect the protrusion of the head 1 between the two lugs 3. A control unit 6 is located in the recess 4 and includes a spring and a toothed member which is engaged with the toothed portion 11.

Specifically, a first axis "A" passes through the center of the inner end of the recess 4, and a second axis "B" extends along the top of each of the ribs 5. A restriction angle "C" is therefore formed between the first axis "A" and each of the second axes "B". Preferably, the restriction angle "C" is between 60 degrees to 75 degrees, including 60 degrees and 70 degrees.

In order to improve the shortcoming that the two lugs can be deformed by high torque operation, the two ribs 5 of the present invention restrict the angle that the head 1 is pivoted relative to the handle 2. Furthermore, because the two ribs 5 are integral with the two lugs 3 and the connection portion 21, so that the force can be shared by the two lugs 3 and the two ribs 5 to effectively prevent deformation to the lugs 3.

Figure 3:
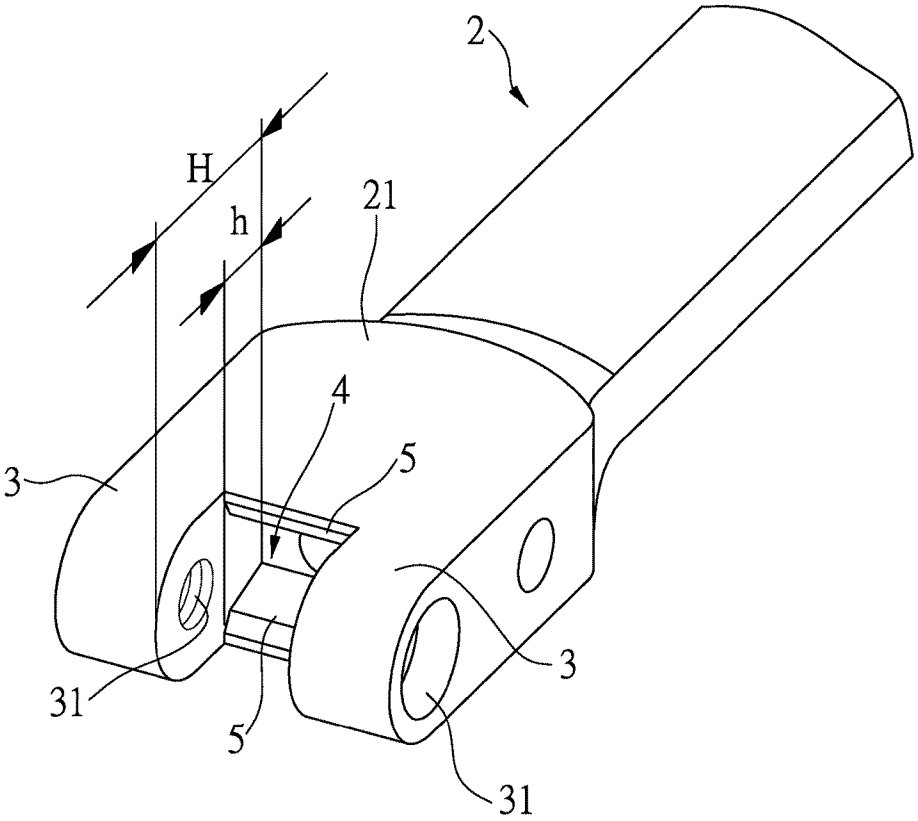
FIG. 3 is a perspective view to show the handle of the hand tool of the present invention.
Figure 4:
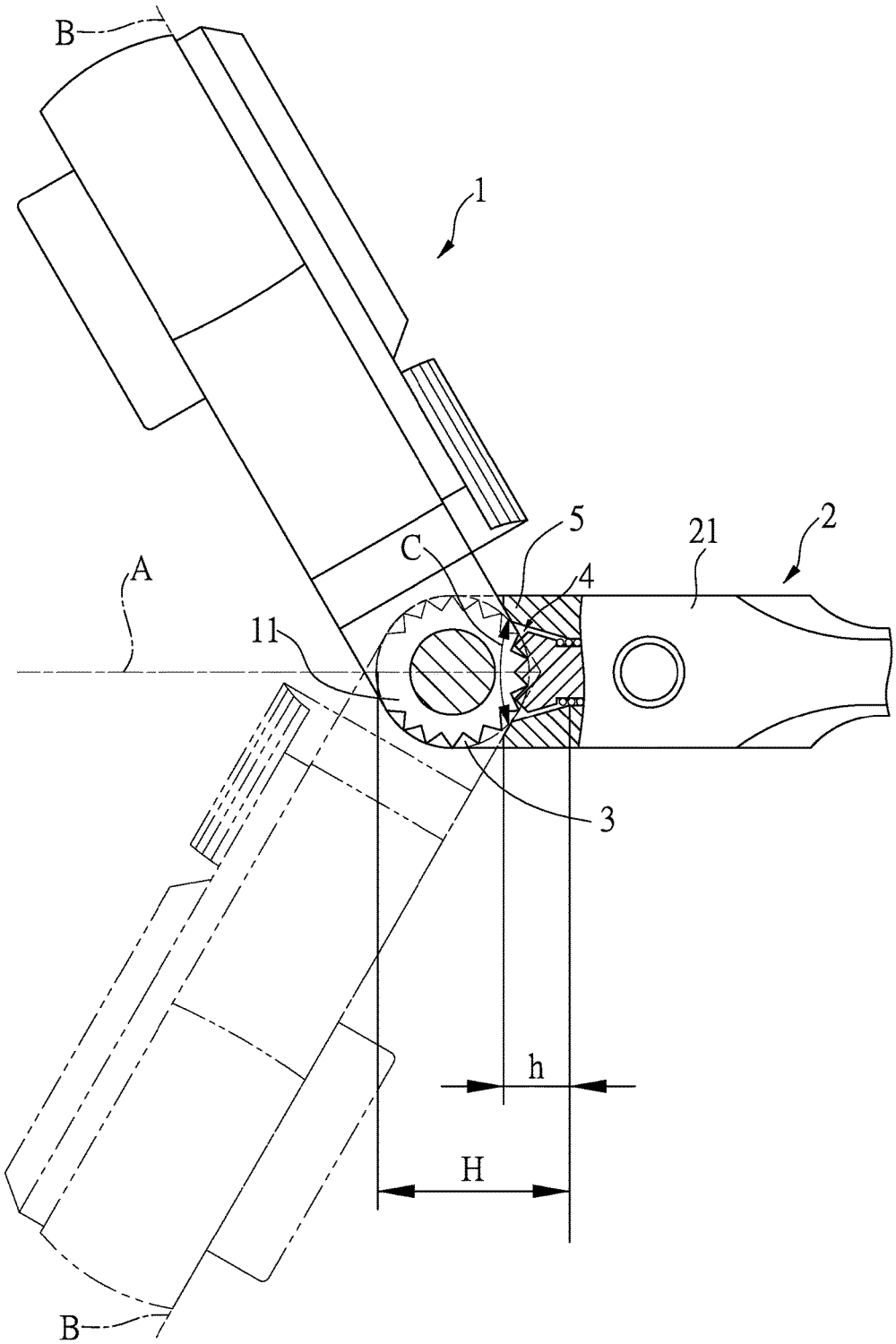
FIG. 4 shows that the head is pivotable relative to the handle.
Figure 5:
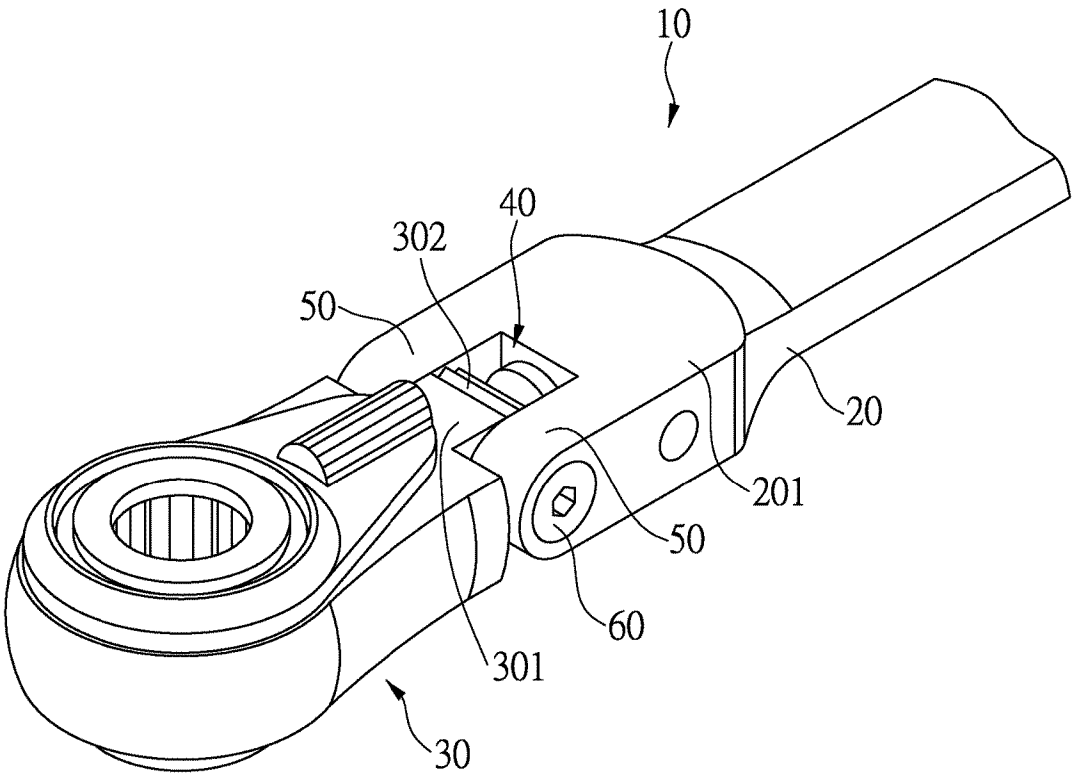
FIG. 5 shows the conventional hand tool.
Figure 6:
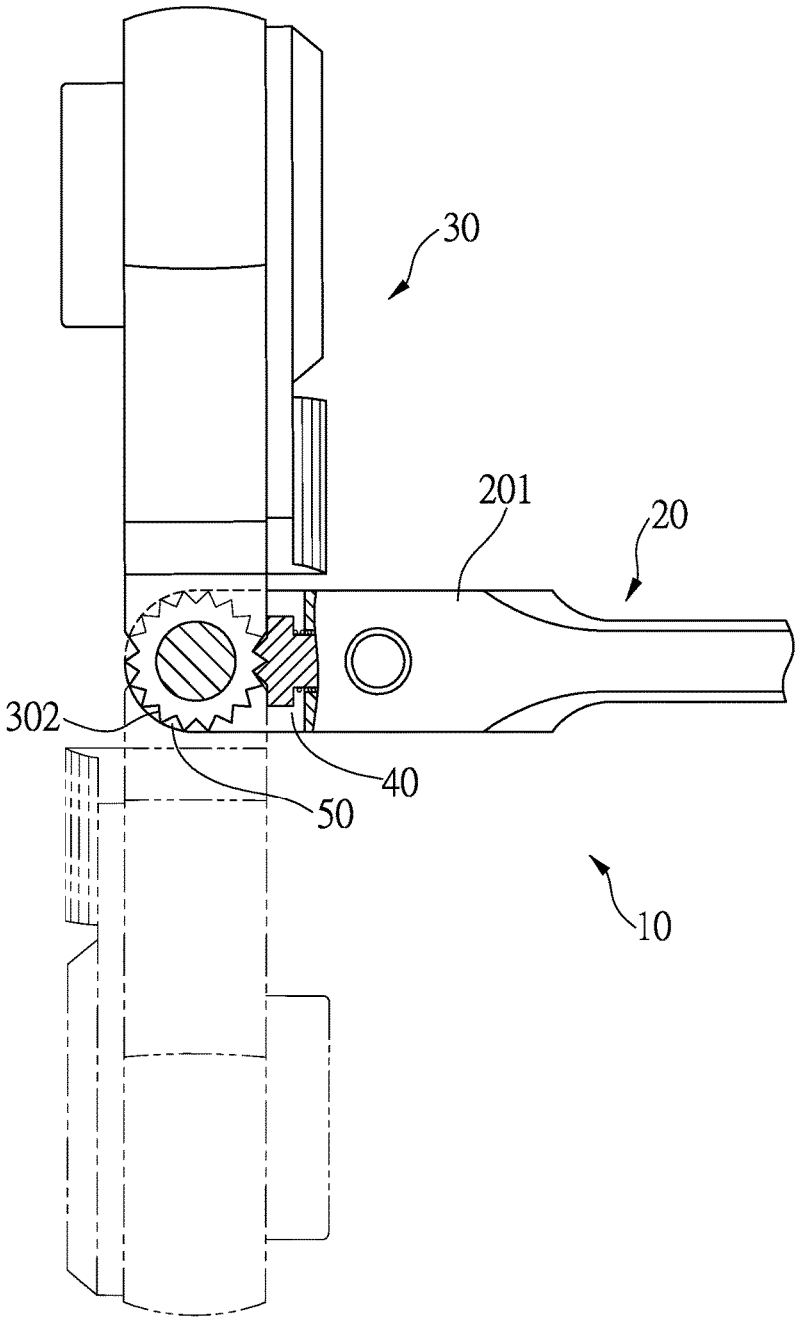
FIG. 6 shows the head of the conventional hand tool is pivotable relative to the handle.
Figure 7:
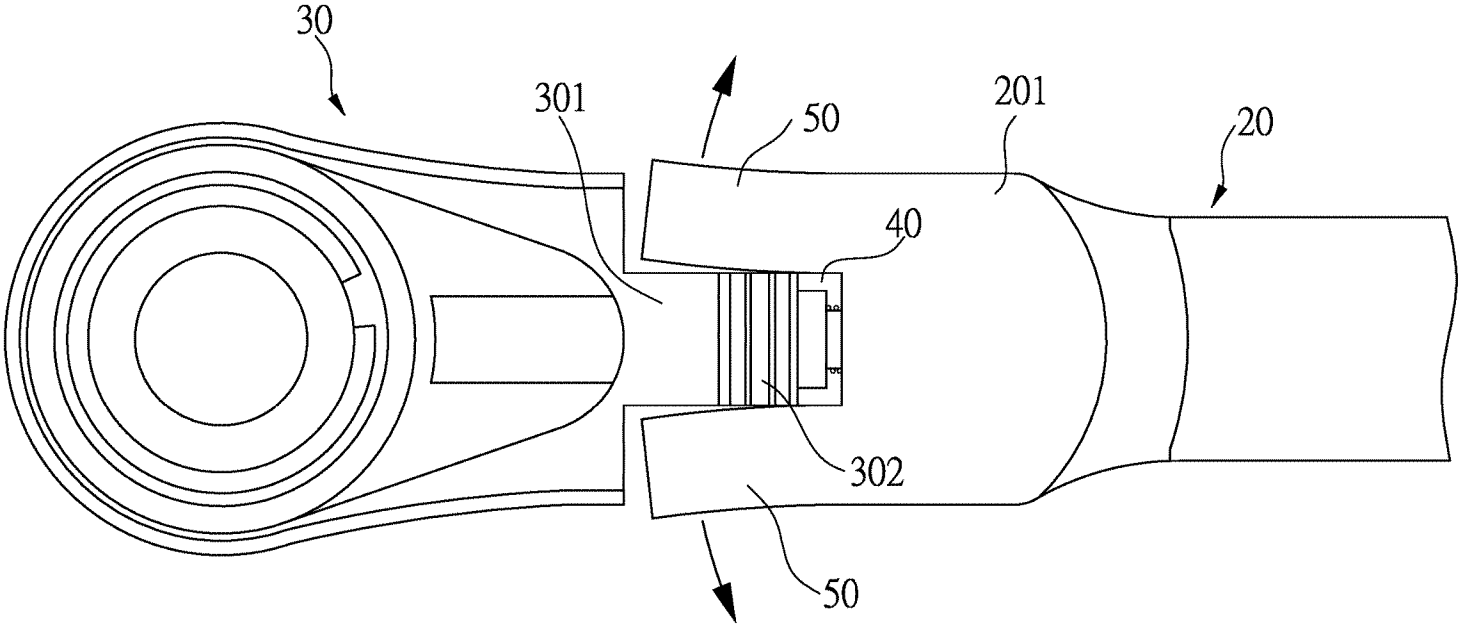
FIG. 7 shows that two lugs of the conventional hand tool are deformed outward.

The restriction angle "C" means the angle that the head 1 is able to be pivoted relative to the handle 2, in other words, the head 1 can be pivoted up to 150 degrees as shown in FIG. 4. As shown in FIGS. 3 and 4, the ribs 5 each have a first height "h" which is measured from the root portion to the top of each rib 5. The two ribs 5 each have a second height "H" which is measured from the room portion to the top of each rib 5. The second height "H" is higher than the first height "h" to ensure that the head 1 is stopped by the ribs 5.

While we have shown and described the embodiment in accordance with the present invention, it should be clear to those skilled in the art that further embodiments may be made without departing from the scope of the present invention.

What is claimed is:

1. A hand tool comprising:

a head having a protrusion extending therefrom, the protrusion having a toothed portion;

a handle having a connection portion formed on one end thereof, two lugs extending from the connection portion so as to form a recess between the two lugs and the connection portion, two ribs respectively extending from the connection portion and located between the two lugs, the two ribs being integral with the two lugs and the connection portion, the protrusion of the head pivotably connected between the two lugs, and a control unit located in the recess and engaged with the toothed portion, the two ribs restricting an angle that the head is pivoted relative to the handle.

2. The hand tool as claimed in claim 1, wherein a first axis passes through a center of an inner end of the recess, a second axis extends along a top of each of the ribs, a restriction angle is formed between the first axis and each of the second axes, the restriction angle is between 60 degrees to 75 degrees, including 60 degrees and 70 degrees.

3. The hand tool as claimed in claim 2, wherein the protrusion of the head and each of the two lugs has a hole, a pin extends through the holes of the protrusion of the head and each of the two lugs to pivotably connect the protrusion of the head between the two lugs.

4. The hand tool as claimed in claim 1, wherein the protrusion of the head and each of the two lugs has a hole, a pin extends through the holes of the protrusion of the head and each of the two lugs to pivotably connect the protrusion of the head between the two lugs.

5. The hand tool as claimed in claim 1, wherein the ribs each have a first height, the two ribs each have a second height which is higher than the first height.

* * * * *